US008471771B2

(12) United States Patent
Su et al.

(10) Patent No.: US 8,471,771 B2
(45) Date of Patent: Jun. 25, 2013

(54) DUAL-BAND ANTENNA

(75) Inventors: Jia-hung Su, Tu Cheng (TW); Kai Shih, Tu Cheng (TW)

(73) Assignee: Cheng UEI Precision Industry Co., Ltd., Tu-Cheng, Taipei (TW)

( * ) Notice: Subject to any disclaimer, the term of this patent is extended or adjusted under 35 U.S.C. 154(b) by 438 days.

(21) Appl. No.: 12/950,879

(22) Filed: Nov. 19, 2010

(65) Prior Publication Data

US 2012/0127059 A1 May 24, 2012

(51) Int. Cl.
*H01Q 1/38* (2006.01)

(52) U.S. Cl.
USPC ..... 343/700 MS; 343/702

(58) Field of Classification Search
USPC ..... 343/700 MS, 702
See application file for complete search history.

(56) References Cited

U.S. PATENT DOCUMENTS 6,166,694 A * 12/2000 Ying ..... 343/702
7,417,588 B2 * 8/2008 Castany et al. ..... 343/700 MS
8,013,796 B2 * 9/2011 Liu et al. ..... 343/702

* cited by examiner

*Primary Examiner* — Hoang V Nguyen
(74) *Attorney, Agent, or Firm* — Cheng-Ju Chiang

(57) ABSTRACT

A dual-band antenna is provided and has a feed base portion, a low-frequency radiation portion and a high-frequency radiation portion. A first end of the feed base portion is bent and extended to form the low-frequency radiation portion which has a first transverse portion, a first longitudinal portion, a second transverse portion, a second longitudinal portion and a third transverse portion. A second end of the feed base portion is bent and extended to form the high-frequency radiation portion which has a third longitudinal portion, a fourth transverse portion and a fourth longitudinal portion. The feed base portion is further bent and extended to form a feed end. The dual-band antenna of the present invention has a roundabout bent structure, so that the dual-band antenna has a better effect for transmitting and receiving electro-magnetic signals of two frequency bands of 900 MHz and 1800 MHz.

7 Claims, 2 Drawing Sheets

DUAL-BAND ANTENNA

FIELD OF THE INVENTION

The present invention relates to an antenna, and more particularly to a dual-band antenna having a better effect for transmitting and receiving electro-magnetic signals.

BACKGROUND OF THE INVENTION

Presently, in wireless communication field, demand of handheld electronic products dramatically increases day by day, and the handheld electronic products are developed according to trends of compactness. Most of traditional handheld electronic products can receive different electro-magnetic signals in two or more communication frequency bands. For allowing a handheld electronic product to receive electromagnetic signals in a plurality of frequency bands, an internal antenna installed in the handheld electronic product is generally designed to have a considerable size and a plurality of radiation portions for receiving different frequency bands, in order to ensure that the handheld electronic product has a better receiving effect.

However, if it needs the internal antenna to receive electromagnetic signals well in at least two frequency bands, the size of the antenna must be designed to be a considerable size. The development trend of compactness inevitably limits usable internal space in the handheld electronic product for receiving the internal antenna. Thus, the limited space in the handheld electronic product for receiving the internal antenna can not satisfy the need of providing a sufficient space for installing the internal antenna with the considerable size. If the handheld electronic product is designed to narrow the antenna receiving space to satisfy the compactness trend of the handheld electronic product, the receiving effect of the handheld electronic product will be inevitably lowered, and even can not normally work during communication.

SUMMARY OF THE INVENTION

A primary object of the present invention is to provide a dual-band antenna, which has a better effect for transmitting and receiving signals and thus can overcome the disadvantages existing in the conventional technologies, as described above.

To achieve the above object, the dual-band antenna provided by the present invention comprises a feed base portion, a low-frequency radiation portion and a high-frequency radiation portion. A first end of the feed base portion is bent and extended to form the low-frequency radiation portion which includes a first transverse portion transversely extended from the first end of the feed base portion, a first longitudinal portion longitudinally extended from a distal end of the first transverse portion, a second transverse portion extended from a distal end of the first longitudinal portion and substantially parallel to the first transverse portion along an identical direction thereof, a second longitudinal portion longitudinally extended from a distal end of the second transverse portion, substantially parallel to the first longitudinal portion and opposite to the first longitudinal portion, and a third transverse portion extended from a distal end of the second longitudinal portion, parallel to the first transverse portion and opposite to the first and second transverse portions. A second end of the feed base portion is bent and extended to form the high-frequency radiation portion which includes a third longitudinal portion longitudinally extended from the second end of the feed base portion, a fourth transverse portion transversely extended from a distal end of the third longitudinal portion and a fourth longitudinal portion extended upward from a distal end of the fourth transverse portion and substantially parallel to the third longitudinal portion. The feed base portion is further bent and extended to form a feed end.

As described above, the dual-band antenna of the present invention has an S-shape roundabout bent structure, so that the dual-band antenna has a better effect for transmitting and receiving electro-magnetic signals of two frequency bands of 900 MHz and 1800 MHz.

DETAILED DESCRIPTION OF THE PREFERRED EMBODIMENTS

The structure and the technical means adopted by the present invention to achieve the above and other objects can be best understood by referring to the following detailed description of the preferred embodiments and the accompanying drawings. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

A dual-band antenna according to the present invention is mainly applied to handheld electronic products, such as mobile phones.

Figure 1:
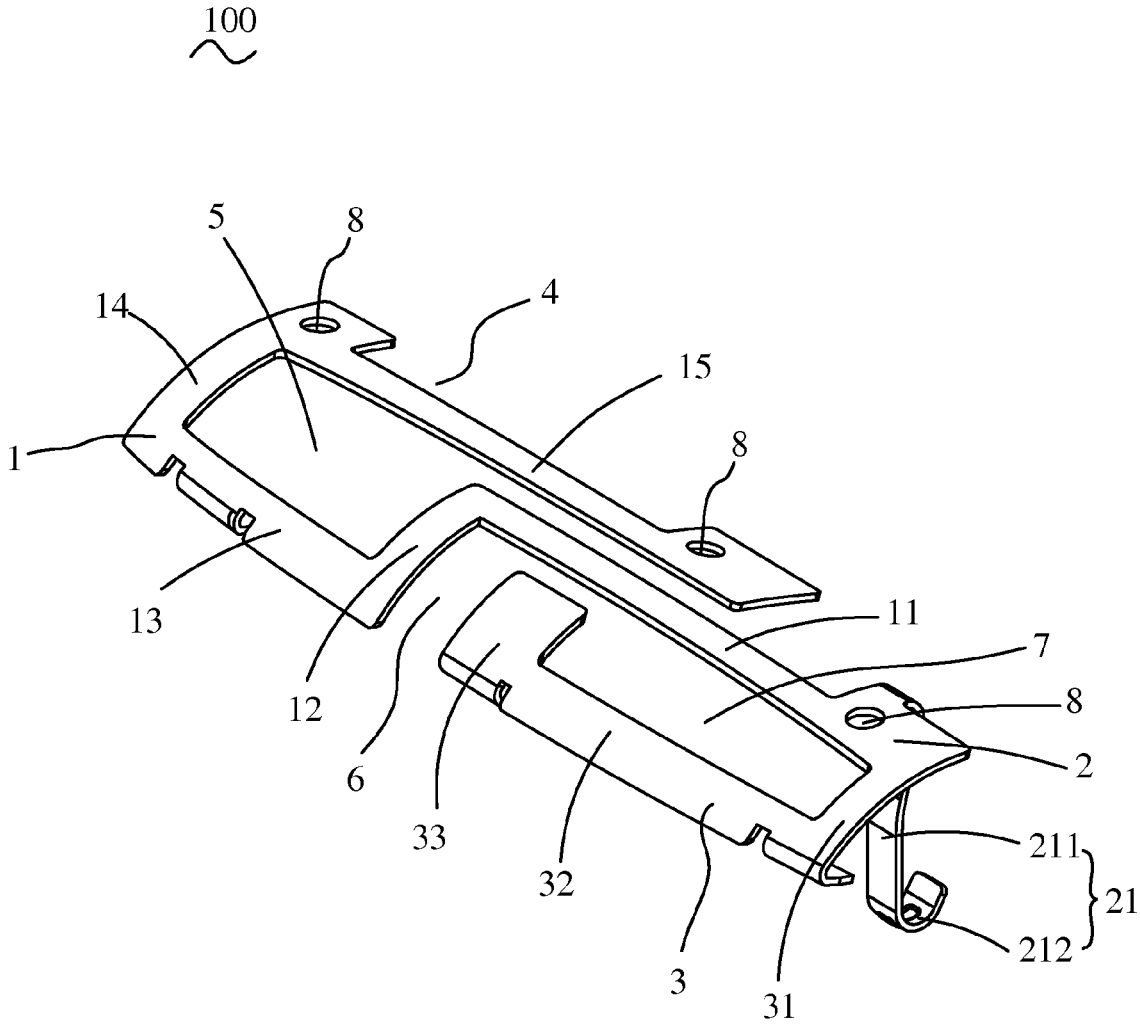
FIG. 1 is a perspective view of a dual-band antenna according to a preferred embodiment of the present invention.
Figure 2:
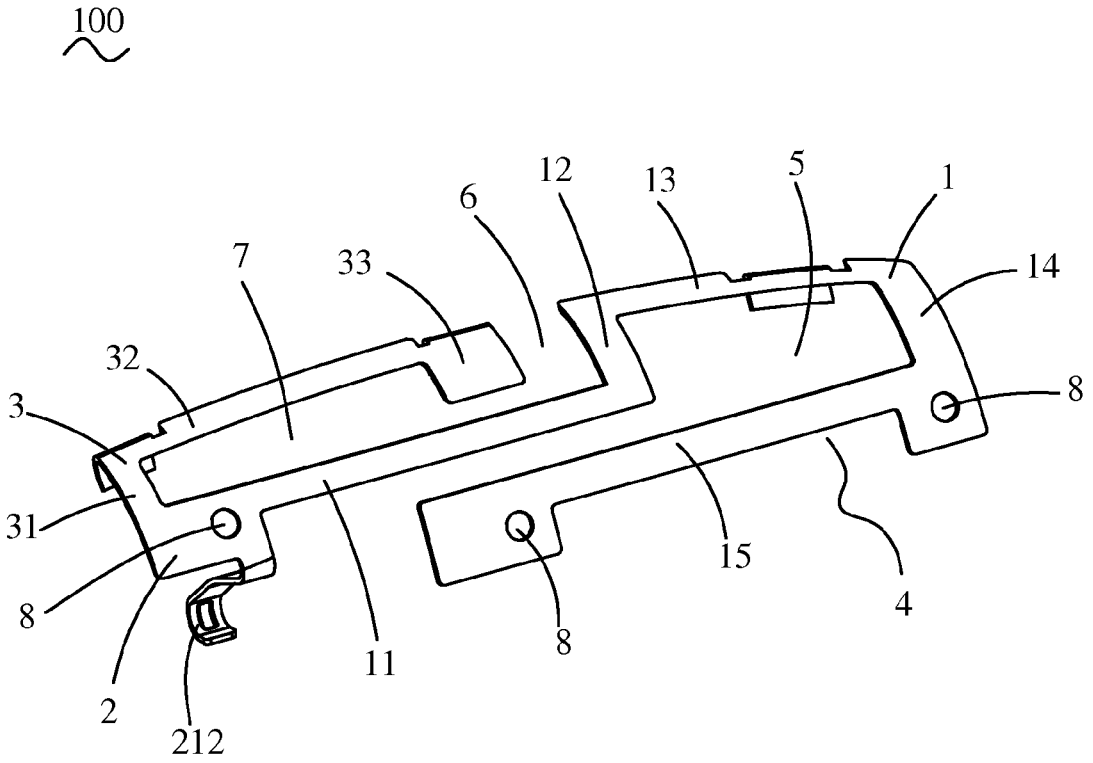
FIG. 2 is another perspective view of the dual-band antenna according to the preferred embodiment of the present invention from a different viewing angle.

Referring now to FIGS. 1 and 2, a dual-band antenna 100 according to a preferred embodiment of the present invention comprises a feed base portion 2 formed by a curved sheet, a low-frequency radiation portion 1 formed by bending a first end of the feed base portion 2 and extended therefrom, and a high-frequency radiation portion 3 formed by bending a second end of the feed base portion 2 and extended therefrom. The low-frequency radiation portion 1 has a first transverse portion 11, a first longitudinal portion 12, a second transverse portion 13, a second longitudinal portion 14 and a third transverse portion 15. The first transverse portion 11 is strip-like, and transversely extended from the first end of the feed base portion 2, wherein an upper surface and a lower surface of the first transverse portion 11 are curved. A distal end of the first transverse portion 11 is extended to form the first longitudinal portion 12 in a curved manner, wherein the first longitudinal portion 12 is vertical to the first transverse portion 11. A distal end of the first longitudinal portion 12 is away from the distal end of the first transverse portion 11, and extended to form the second transverse portion 13. A distal end of the second transverse portion 13 is extended upward to form the second longitudinal portion 14 in a curved manner, wherein the second longitudinal portion 14 is extended toward the first transverse portion 11 and parallel to the first longitudinal portion 12. A distal end of the second longitudinal portion 14 is extended to form the third transverse portion 15 formed by an elongated curved plate. The third transverse portion 15 is parallel to the first transverse portion 11, while a distal end of the third transverse portion 15 is substantially extended up to a central position of the first transverse portion 11. An outer side edge of the third transverse portion 15 is further formed with an indentation 4. The first transverse portion 11, the first longitudinal portion 12, the second transverse portion 13, the second longitudinal portion 14 and the third transverse portion 15 commonly define a substantial L-shape first space 5.

Referring still to FIGS. 1 and 2, a second end (or side edge) of the feed base portion 2 is bent and extended to form the high-frequency radiation portion 3, wherein the high-frequency radiation portion 3 has a third longitudinal portion 31, a fourth transverse portion 32 and a fourth longitudinal portion 33. The third longitudinal portion 31 is longitudinally extended from the second end of the feed base portion 2 along an identical direction of the first longitudinal portion 12 and parallel to the first longitudinal portion 12. A distal end of the third longitudinal portion 31 is extended toward the first longitudinal portion 12 to form the fourth transverse portion 32. A distal end of the fourth transverse portion 32 is extended upward and toward the first transverse portion 11 to form the fourth longitudinal portion 33 formed by a substantial square plate in a curved manner. A predetermined distance is defined between a distal end of the fourth longitudinal portion 33 and the first transverse portion 11. The width of the fourth longitudinal portion 33 is greater than that of the first transverse portion 11, the first longitudinal portion 12, the second transverse portion 13, the second longitudinal portion 14, the third transverse portion 15, the third longitudinal portion 31 or the fourth transverse portion 32 (i.e. any foregoing transverse or longitudinal portion). A gap 6 is defined between the fourth longitudinal portion 33 and the first longitudinal portion 12. The first transverse portion 11, the feed base portion 2, the third longitudinal portion 31, the fourth transverse portion 32 and the fourth longitudinal portion 33 commonly define a second space 7, wherein the second space 7 is communicated with the gap 6. A connection portion of the second longitudinal portion 14 and the third transverse portion 15 is formed with a positioning hole 8. A distal end of the third transverse portion 15 is also formed with a positioning hole 8. A connection portion of the first transverse portion 11 and the feed base portion 2 is also formed with a positioning hole 8.

A side edge of the feed base portion 2 is further bent and extended to form a feed end 21, wherein the feed end 21 is substantially hook-like and has an elastically-engaging feed portion 211 and a contact feed portion 212.

Referring to FIGS. 1 and 2 again, when the dual-band antenna 100 of the present invention is applied to communication, electro-magnetic signals can be fed into the feed end 21 of the feed base portion 2, wherein the third longitudinal portion 31, the fourth transverse portion 32 and the fourth longitudinal portion 33 of the high-frequency radiation portion 3 simultaneously generate a resonance phenomenon with high-frequency electro-magnetic signals of 1800 MHz, so that the antenna can transmit and receive signals of DCS1800 communication system. Because the first space 5 and the second space 7 simultaneously generate a resonance phenomenon with the high-frequency electro-magnetic signals of 1800 MHz, so that the antenna has a better receiving effect in a high-frequency band for carrying out a higher receiving effect. On the other hand, electro-magnetic signals can be fed into the feed end 21 of the feed base portion 2, wherein the feed base portion 2, the first transverse portion 11, the first longitudinal portion 12, the second transverse portion 13, the second longitudinal portion 14 and the third transverse portion 15 commonly construct a roundabout electric circuit which can generate a resonance phenomenon with low-frequency electro-magnetic signals of 900 MHz, so that the antenna can transmit and receive signals of GSM900 communication system.

When the dual-band antenna 100 according to the present invention is designed, the second longitudinal portion 14 of the low-frequency radiation portion 1 can be suitably widen according to actual desire, so as to provide a better effect of the dual-band antenna 100 for receiving the electro-magnetic signals of 900 MHz.

As described above, the dual-band antenna 100 according to the present invention has an S-shape roundabout bent structure, so that the dual-band antenna 100 has a better effect for transmitting and receiving electro-magnetic signals of two frequency bands of 900 MHz and 1800 MHz.

The present invention has been described with a preferred embodiment thereof and it is understood that many changes and modifications to the described embodiment can be carried out without departing from the scope and the spirit of the invention that is intended to be limited only by the appended claims.

What is claimed is:

1. A dual-band antenna, comprising:

a feed base portion;

a low-frequency radiation portion formed by bending a first end of the feed base portion and extended therefrom, wherein the low-frequency radiation portion including:

a first transverse portion transversely extended from the first end of the feed base portion;

a first longitudinal portion longitudinally extended from a distal end of the first transverse portion;

a second transverse portion extended from a distal end of the first longitudinal portion and substantially parallel to the first transverse portion along an identical direction thereof;

a second longitudinal portion extended from a distal end of the second transverse portion, substantially parallel to the first longitudinal portion and opposite to the first longitudinal portion; and a third transverse portion extended from a distal end of the second longitudinal portion, parallel to the first transverse portion and opposite to the first and second transverse portions;

a high-frequency radiation portion formed by bending a second end of the feed base portion and extended therefrom, wherein the high-frequency radiation portion includes:

a third longitudinal portion longitudinally extended from the second end of the feed base portion;

a fourth transverse portion transversely extended from a distal end of the third longitudinal portion; and a fourth longitudinal portion extended from a distal end of the fourth transverse portion and substantially parallel to the third longitudinal portion; and a feed end formed by bending the feed base portion and extended therefrom.

2. The dual-band antenna according to claim 1, wherein a distal end of the third transverse portion is substantially extended to a central position of the first transverse portion.

3. The dual-band antenna according to claim 1, wherein a distance is defined between a distal end of the fourth longitudinal portion and the first transverse portion.

4. The dual-band antenna according to claim 1, wherein the width of the fourth longitudinal portion is greater than that of the first transverse portion, the first longitudinal portion, the second transverse portion, the second longitudinal portion, the third transverse portion, the third longitudinal portion or the fourth transverse portion.

5. The dual-band antenna according to claim 1, wherein the feed end is substantially hook-like and has an elastically-engaging feed portion and a contact feed portion.

6. The dual-band antenna according to claim 1, wherein the first transverse portion, the first longitudinal portion, the second transverse portion, the second longitudinal portion and the third transverse portion commonly define a first space.

7. The dual-band antenna according to claim 1, wherein the first transverse portion, the feed base portion, the third longitudinal portion, the fourth transverse portion and the fourth longitudinal portion commonly define a second space.

* * * * *